US007770425B2

(12) United States Patent
Egerton et al.

(10) Patent No.: US 7,770,425 B2
(45) Date of Patent: Aug. 10, 2010

(54) CONTAINER MANUFACTURING PROCESS HAVING FRONT-END WINDER ASSEMBLY

(75) Inventors: Daniel Egerton, Skipton (GB); David William Smith, Oakworth (GB)

(73) Assignee: Crown, Packaging Technology, Inc., Alsip, IL (US)

( * ) Notice: Subject to any disclaimer, the term of this patent is extended or adjusted under 35 U.S.C. 154(b) by 0 days.

(21) Appl. No.: 12/108,926

(22) Filed: Apr. 24, 2008

(65) Prior Publication Data

US 2009/0266129 A1 Oct. 29, 2009

(51) Int. Cl.
*B21D 51/26* (2006.01)

(52) U.S. Cl. ..... 72/94; 72/405.03

(58) Field of Classification Search ..... 72/94, 72/405.03, 379.4; 74/412 R, 413, 416, 417, 74/421 R; 29/37 R, 38 R, 38 B, 38 E, 35.5–48.5 A; 198/471.1, 470

See application file for complete search history.

(56) References Cited

U.S. PATENT DOCUMENTS

| | | | |
|---|---|---|---|
| 137,400 | A | 4/1873 | Ahrend |
| 548,888 | A | 10/1895 | Noteman |
| 593,755 | A | 11/1897 | Pond et al. |
| 1,459,584 | A | 6/1923 | Ericsson |
| 1,498,940 | A | 6/1924 | Wheeler |
| 1,621,301 | A | 3/1927 | Wright |
| 2,467,278 | A | 4/1949 | Thompson |
| 2,550,156 | A | 4/1951 | Lyon |
| 2,686,551 | A | 8/1954 | Laxo |
| 2,874,562 | A | 2/1959 | Cross |
| 2,928,454 | A | 3/1960 | Laxo |
| 2,940,502 | A | 6/1960 | La |
| 3,096,709 | A | 7/1963 | Eldred et al. |
| 3,344,685 | A | 10/1967 | Crouzet |
| 3,374,684 | A | 3/1968 | Greven |
| 3,406,648 | A | 10/1968 | David |
| 3,418,837 | A | 12/1968 | Vanderlaan et al. |
| 3,599,780 | A | 8/1971 | Sorbie |
| 3,621,530 | A | 11/1971 | Pflieger et al. |
| 3,635,069 | A | 1/1972 | Eickenhorst |

(Continued)

FOREIGN PATENT DOCUMENTS

| | | |
|---|---|---|
| CA | 2536841 | 2/2006 |

(Continued)

OTHER PUBLICATIONS

U.S. Appl. No. 11/643,935, filed Dec. 22, 2006, Shortridge et al.
Office Communication submitted on Nov. 30, 2009.

*Primary Examiner*—Dana Ross
*Assistant Examiner*—Stephanie Jennings
(74) *Attorney, Agent, or Firm*—Woodcock Washburn LLP

(57) ABSTRACT

A winder assembly is provided for rotating a component of a can necking machine to a desired angular position suitable for performing maintenance on the component. The winder assembly includes a shaft coupled to a motor of that drives the components of the can necking machine during operation. A handle can be removably connected to the shaft, such that rotation of the handle in a rotational direction correspondingly causes the shaft to rotate. The shaft causes the motor to rotate, which drives a gear train that rotates the components of the necking machine that are coupled to the gear train.

22 Claims, 8 Drawing Sheets

U.S. PATENT DOCUMENTS

| | | | | |
|---|---|---|---|---|
| 3,659,443 | A | 5/1972 | Ball | |
| 3,687,098 | A | 8/1972 | Maytag | |
| 3,797,429 | A | 3/1974 | Wolfe | |
| 3,983,729 | A | 10/1976 | Traczyk et al. | |
| 4,030,432 | A | 6/1977 | Miller et al. | |
| 4,164,997 | A | 8/1979 | Mueller | |
| 4,341,103 | A | 7/1982 | Escallon et al. | |
| 4,513,595 | A | 4/1985 | Cvacho | |
| 4,519,232 | A | 5/1985 | Traczyk et al. | |
| 4,576,024 | A | 3/1986 | Weber | |
| 4,590,788 | A | 5/1986 | Wallis | |
| 4,671,093 | A | 6/1987 | Dominico et al. | |
| 4,693,108 | A | 9/1987 | Traczyk et al. | |
| 4,817,409 | A | 4/1989 | Bauermeister | |
| 4,838,064 | A | 6/1989 | Paess | |
| 4,892,184 | A | 1/1990 | Vander Griendt et al. | |
| 5,209,101 | A | 5/1993 | Finzer | |
| 5,226,303 | A | 7/1993 | Dieden et al. | |
| 5,235,839 | A | 8/1993 | Lee, Jr. et al. | |
| 5,245,848 | A | 9/1993 | Lee, Jr. et al. | |
| 5,282,375 | A | 2/1994 | Lee, Jr. et al. | |
| 5,349,836 | A | 9/1994 | Lee, Jr. | |
| 5,353,619 | A | 10/1994 | Chu et al. | |
| 5,467,628 | A | 11/1995 | Bowlin et al. | |
| 5,540,320 | A | 7/1996 | Sarto et al. | |
| 5,553,826 | A | 9/1996 | Schultz | |
| 5,611,231 | A | 3/1997 | Marritt et al. | |
| 5,634,364 | A | 6/1997 | Gardner et al. | |
| 5,676,006 | A | 10/1997 | Marshall | |
| 5,713,235 | A | 2/1998 | Diekhoff | |
| 5,755,130 | A | 5/1998 | Tung et al. | |
| 5,782,308 | A | 7/1998 | Latten et al. | |
| 5,906,120 | A | 5/1999 | Thacker et al. | |
| 6,032,502 | A | 3/2000 | Halasz et al. | |
| 6,055,836 | A | 5/2000 | Waterworth et al. | |
| 6,085,563 | A | 7/2000 | Heiberger et al. | |
| 6,167,743 | B1 | 1/2001 | Marritt et al. | |
| 6,176,006 | B1 | 1/2001 | Milliman et al. | |
| 6,178,797 | B1 | 1/2001 | Marshall et al. | |
| 6,199,420 | B1 | 3/2001 | Bartosch | |
| 6,240,760 | B1 | 6/2001 | Heiberger et al. | |
| 6,571,986 | B1 | 6/2003 | Simmons | |
| 6,644,083 | B2 | 11/2003 | Pakker | |
| 6,658,913 | B1 | 12/2003 | Zanzerl et al. | |
| 6,661,020 | B2 | 12/2003 | Schill et al. | |
| 6,672,122 | B2 | 1/2004 | Mustread et al. | |
| 6,698,265 | B1 * | 3/2004 | Thomas | 72/94 |
| 6,752,000 | B2 | 6/2004 | Reynolds et al. | |
| 6,779,651 | B1 | 8/2004 | Linglet et al. | |
| 7,028,857 | B2 | 4/2006 | Peronek | |
| 7,069,765 | B2 | 7/2006 | Grove et al. | |
| 7,100,417 | B2 | 9/2006 | Yamanaka et al. | |
| 2002/0029599 | A1 * | 3/2002 | Heiberger et al. | 72/94 |
| 2004/0069027 | A1 | 4/2004 | Fukushima | |
| 2005/0193796 | A1 | 9/2005 | Heiberger et al. | |
| 2006/0070470 | A1 * | 4/2006 | McGill et al. | 74/416 |
| 2006/0101884 | A1 | 5/2006 | Schill et al. | |
| 2006/0101885 | A1 | 5/2006 | Schill et al. | |
| 2006/0101889 | A1 | 5/2006 | Schill et al. | |
| 2006/0104745 | A1 | 5/2006 | Schill et al. | |
| 2007/0227218 | A1 | 10/2007 | Shortridge | |
| 2007/0227320 | A1 | 10/2007 | Marshall | |
| 2007/0227859 | A1 | 10/2007 | Marshall et al. | |
| 2007/0249424 | A1 | 10/2007 | Marshall et al. | |
| 2007/0251803 | A1 | 11/2007 | Schill et al. | |
| 2007/0283544 | A1 | 12/2007 | Schill et al. | |
| 2007/0283665 | A1 | 12/2007 | Schill et al. | |

FOREIGN PATENT DOCUMENTS

| | | | |
|---|---|---|---|
| DE | 19 39 623 | A1 | 2/1970 |
| DE | 101 56 085 | A1 | 5/2003 |
| EP | 0 885 076 | | 7/2002 |
| FR | 2 881 123 | A1 | 7/2006 |
| GB | 189707306 | | 3/1898 |
| GB | 2173437 | A | 10/1986 |
| JP | 2002 102968 | | 4/2002 |
| JP | 2003-237752 | | 8/2003 |
| JP | 2003 251424 | | 9/2003 |
| JP | 2003-252321 | | 9/2003 |
| JP | 2003320432 | | 11/2003 |
| JP | 2004-002557 | | 1/2004 |
| JP | 2004-130386 | | 4/2004 |
| JP | 2004160468 | | 6/2004 |
| JP | 2004-217305 | | 8/2004 |
| JP | 2005-022663 | | 1/2005 |
| JP | 2006-176140 | | 7/2006 |
| JP | 2006-176183 | | 7/2006 |
| WO | WO 94/12412 | | 6/1994 |
| WO | WO 97/37786 | A1 | 10/1997 |
| WO | WO 97/49509 | | 12/1997 |
| WO | WO 00/23212 | A | 4/2000 |
| WO | WO 2006/055185 | A | 5/2006 |
| WO | WO 2006/067901 | | 6/2006 |

* cited by examiner

CONTAINER MANUFACTURING PROCESS HAVING FRONT-END WINDER ASSEMBLY

BACKGROUND

The present invention relates to an apparatus for manufacturing containers, and in particular relates to a mechanism for manually adjusting the angular position of rotating components of a container manufacturing process.

Metal beverage cans are designed and manufactured to withstand high internal pressure—typically 90 or 100 psi. Can bodies are commonly formed from a metal blank that is first drawn into a cup. The bottom of the cup is formed into a dome and a standing ring, and the sides of the cup are ironed to a desired can wall thickness and height. After the can is filled, a can end is placed onto the open can end and affixed with a seaming process.

It has been the conventional practice to reduce the diameter at the top of the can to reduce the weight of the can end in a process referred to as necking. Cans can be necked in a "spin necking" process in which cans are rotated with rollers that reduce the diameter of the neck. Most cans are necked in a "die necking" process in which cans are longitudinally pushed into dies to gently reduce the neck diameter over several stages. For example, reducing the diameter of a can neck from a conventional body diameter of $2^{11}/_{16}{}^{th}$ inches to $2^{6}/_{16}{}^{th}$ inches (that is, from a 211 to a 206 size) often requires multiple stages, often 14.

Each of the necking stages typically includes a main turret shaft that carries a starwheel for holding the can bodies, a die assembly that includes the tooling for reducing the diameter of the open end of the can, and a pusher ram to push the can into the die tooling. Each necking stage also typically includes a transfer turret assembly to transfer can bodies between turret starwheels. Transfer turret assemblies typically include a rotating transfer starwheel that includes a plurality of pockets that each retain a received can body under a vacuum pressure force. The rotating starwheel receives can bodies from a first operation stage, and delivers the can bodies to a second operation stage.

From time to time, it can become necessary or desirable to perform routine maintenance or repair maintenance on various rotatable components of the manufacturing process. However, because the manufacturing process components can be disposed in close proximity to each other, one component may interfere with the ability to provide maintenance on a neighboring rotatable component. For instance, when one wishes to access a desired location on one of the rotatable components, that location may not be easily accessible due to interference with a neighboring component, or because the user may be required to assume an awkward posture to access the desired location. As a result, it has become desirable to rotate the rotatable component to a desired angular position that removes the desired location from interference with neighboring process components, and that allows a user to easily access the desired location.

SUMMARY

A multi-stage can necking machine is provided. The necking machine includes a plurality of operation stages. Each operation stage, such as a necking stage, includes at least one rotating shaft projecting forward from a front end of a support. Each shaft includes a gear, and the gears of each operation stage are in meshed communication to form a continuous gear train. The necking machine further includes at least one motor coupled to the gear train and operable to transmit power to the gear train. The necking machine further includes a winder assembly. The winder assembly includes a shaft operably coupled to the gear train. The shaft extends forward from the support. The winder assembly further includes a handle connected to the shaft. The handle can be manually actuated to rotate the shafts of the plurality of operation stages. The winder enables the machine to be rotated in small, controllable increments to facilitate maintenance or any other reason. This manual winding may be accomplished from the front of the machine such that the person controlling the winding can see the position of the turret, starwheel, or other part of the machine to be positioned.

These and other aspects of the invention are not intended to define the scope of the invention for which purpose claims are provided. In the following description, reference is made to the accompanying drawings, which form a part hereof, and in which there is shown by way of illustration, and not limitation, a preferred embodiment of the invention. Such embodiment also does not define the scope of the invention and reference must therefore be made to the claims for this purpose

BRIEF DESCRIPTION OF THE DRAWINGS

The following drawings are presented by way of illustration, and not limitation, in which like reference numerals correspond to like elements throughout, and in which.

DETAILED DESCRIPTION

An example embodiment of a multi-stage can necking machine is described herein as including a plurality of operation stages. The multi-stage can necking machine includes a manual winder assembly that can facilitate adjustment of the angular position of a plurality of movable components of the operation stages, for instance when one wishes to perform routine maintenance or repair maintenance (generally referred to herein as "maintenance") on one of the components. The present invention is not intended to be limited to the disclosed configuration, but can encompass use of the technology disclosed in alternative manufacturing application as defined by the appended claims.

Figure 1:
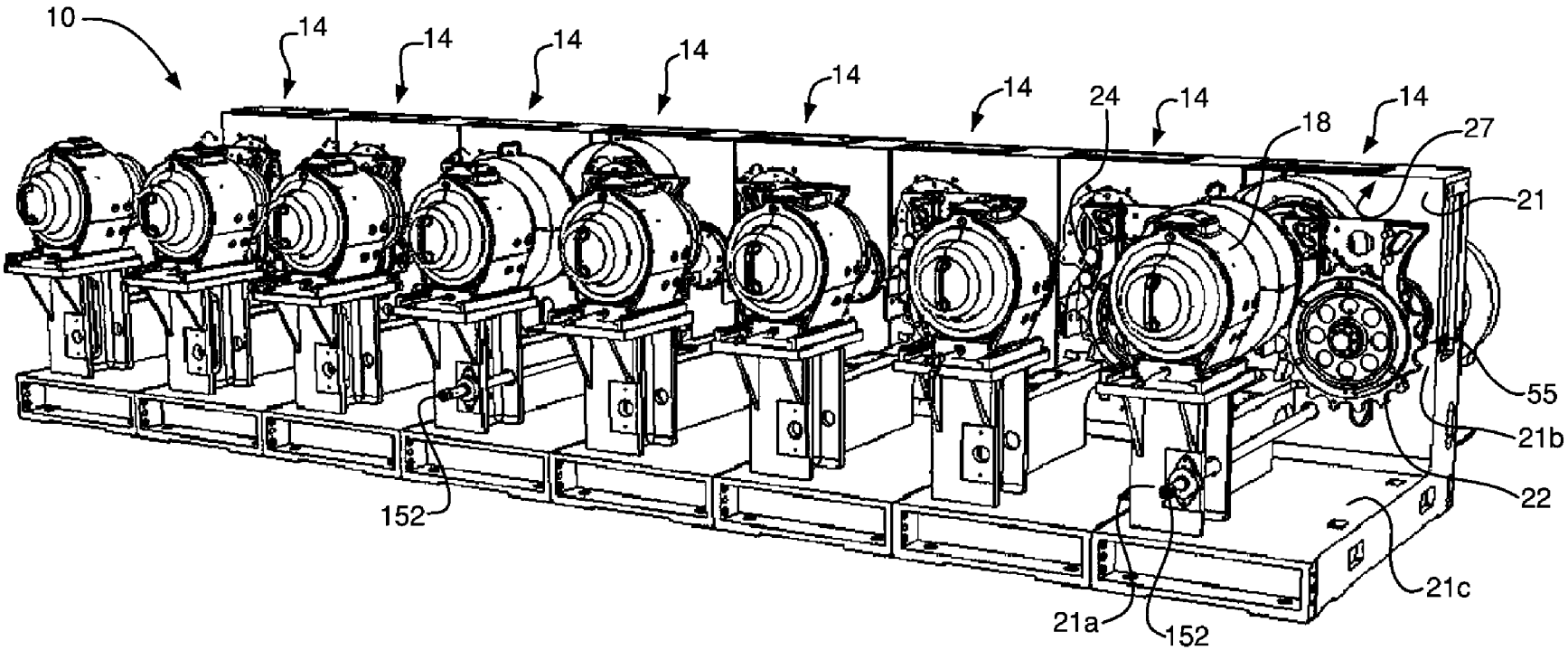
FIG. 1 is a perspective view of a multi-stage can necking machine constructed in accordance with certain aspects of the present invention.

Referring to FIG. 1, a multi-stage can necking machine 10 can include several can body operation stages carried by a support structure 21 or alternative support structure. The support structure 21 includes a pedestal 21*a* at its front, an upright support 21*b* at its rear end, and a base 21*c* extending forward from the upright support 21*b*, and connecting the upright support 21*b* and the pedestal 21*a*. The upright support 21*b* defines a front end or surface 27 and an opposing back end or surface 25 (see FIG. 5). The direction term "forward" and derivatives thereof thus refer to a direction from the back end 25 of the upright support 21*b* towards the front end 27, and the direction term "rearward" and derivatives thereof thus refer to a direction from the front end 27 of the upright support 21*b* toward the back end 25, unless otherwise specified.

The can necking machine 10 can include several necking stages 14, each including a necking station 18 that is adapted to incrementally reduce the diameter of an open end of a can body 24, and a transfer station 55 that can include a starwheel 22 that is operable to transfer the can body 24 to a downstream necking stage or other operation stage. The transfer starwheel 22 can also deliver can bodies from an inlet of the necking machine, and can further transfer can bodies to an outlet of the necking machine.

In addition to the can necking stations 18, the can necking machine 10 can include additional process stations, such as a conventional input station and a waxer station disposed at an inlet of the necking stages 14 (not shown), a bottom reforming station that forms a bottom portion of each can body 24, a flanging station that prepares the cam rim for seaming, and a light testing station positioned at an outlet of the necking stages 14 that determines whether each can body is structurally sound. Accordingly, unless otherwise specified, the term "operation stage" is intended to include any or all of the above-identified process stations, alone or in combination with a juxtaposed transfer station, and/or any additional stations or apparatus that can be included in a can necking process. The waxer station can be configured as described in co-pending U.S. patent application Ser. No. 12/109,031 filed on even date entitled "Apparatus for Rotating a Container Body," the disclosure of which is hereby incorporated by reference as if set forth in its entirety herein.

Figure 2:
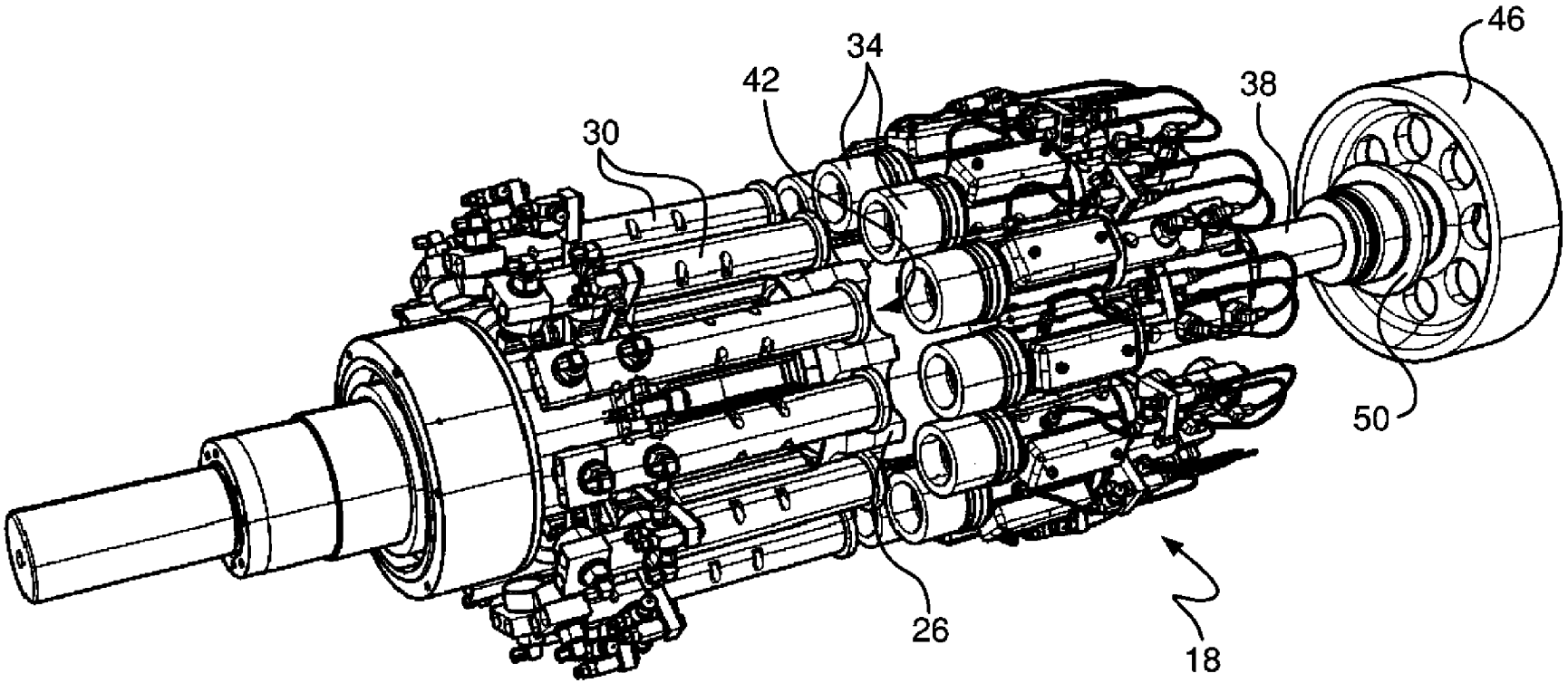
FIG. 2 is a perspective view of a necking station and gear mounted on a main turret shaft of the multi-stage necking machine illustrated in FIG. 1, with surrounding and supporting parts removed for clarity.

Referring now to FIG. 2, each necking station 18 can include a main turret 26, a set of pusher rams 30, and a set of dies 34. The main turret 26, the pusher rams 30, and the dies 34 are each mounted on a main turret shaft 38. The main turret shaft 38 extends forward from, and is supported for rotation by, the upright support 21*b*. A plate can be mounted near the end of shaft 38 to help ensure that the shaft 38 does not move within the support 21*b*.

As shown, the main turret 26 has a plurality of pockets 42 formed therein. Each pocket 42 has a pusher ram 30 on one side of the pocket 42 and a corresponding die 34 on the other side of the pocket 42. During operation, each pocket 42 is adapted to receive a can body and securely holds the can body in place by mechanical means, such as by the action pusher ram and the punch and die assembly, and compressed air, as is understood in the art. During the necking operation, the open end of the can body is brought into contact with the die 34 by the pusher ram 30 as the pocket on main turret 26 carries the can body through an arc along a top portion of the necking station 18.

The die 34, when viewed in transverse cross section, is typically designed to have a lower cylindrical surface with a dimension equal to the diameter of the can body, a curved transition zone, and a reduced diameter upper cylindrical surface above the transition zone. During the necking operation, the can body is moved up into die 34 such that the open end of the can body is placed into touching contact with the transition zone of die 34. As the can body 24 is moved further upward into die 34, the upper region of the can body is forced past the transition zone into a snug position between the inner reduced diameter surface of die 34 and a form control member or sleeve. The diameter of the upper region of the can is thereby given a reduced dimension by die 34. A curvature is formed in the can wall corresponding to the surface configuration of the transition zone of die 34. The can is then lowered out of die 34 and transferred to an adjacent transfer starwheel.

Figure 5:
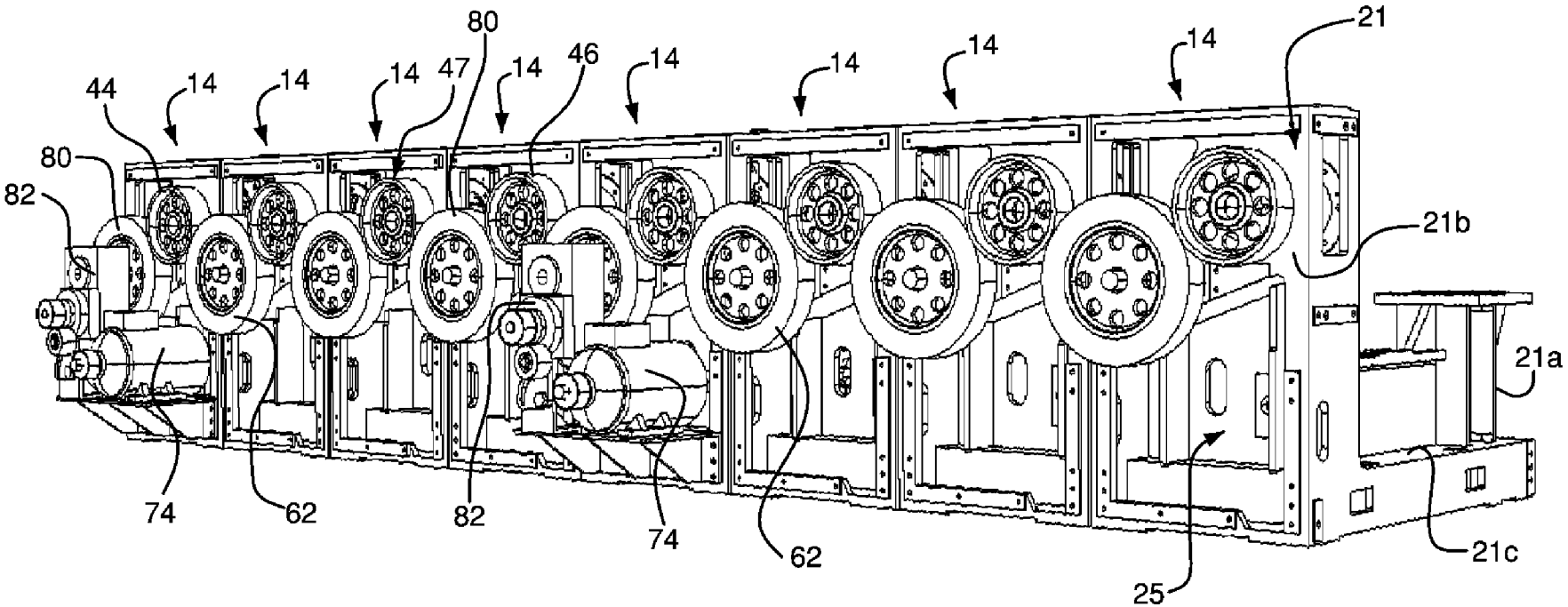
FIG. 5 is a perspective view of a back side of the multi-stage can necking machine illustrated in FIG. 1.

The necking station 18 further includes a main turret gear 46 that is mounted proximate to an end of the main turret shaft 38 at the rear end 25 of the upright support 21*b* (see FIG. 5). The main turret gear 46 can be made of a suitable material, and preferably steel.

The can body 24 can be passed through any number of necking stations 18 depending on the desired diameter of the open end of the can body 24. For example, the multi-stage can necking machine 10 includes eight stages 14, and each stage incrementally reduces the diameter of the open end of the can body 24 in the manner described above.

It should thus be appreciated that while the necking stations 18 include rotating components, other components of the can necking machine can also rotate during operation. For instance, referring now to FIG. 3, the transfer station 55 can include a transfer shaft 54 that supports a transfer starwheel 22 of the type described above. The starwheel 22 can include any desired number of pockets 58 formed therein. For example each starwheel 22 can include twelve pockets 58 or even eighteen pockets 58, depending on the particular application and goals of the machine design. Each pocket 58 is adapted to receive a can body and retains the can body using a vacuum force. The vacuum force should be strong enough to retain the can body as the starwheel 22 carries the can body through an arc along a bottom of the starwheel 22.

The transfer station 55 can further include a gear 62 (shown schematically in FIG. 3 without teeth) that is mounted proximate to an end of the shaft 54 at to the rear end 25 of the upright support 21*b* (see FIG. 5). The gear 62 can be made of steel but preferably is made of a composite material in accordance with certain aspects of the present invention. In one example, each gear 46 can be made of any conventional material, such as a reinforced plastic, such as Nylon 12.

Figure 3:
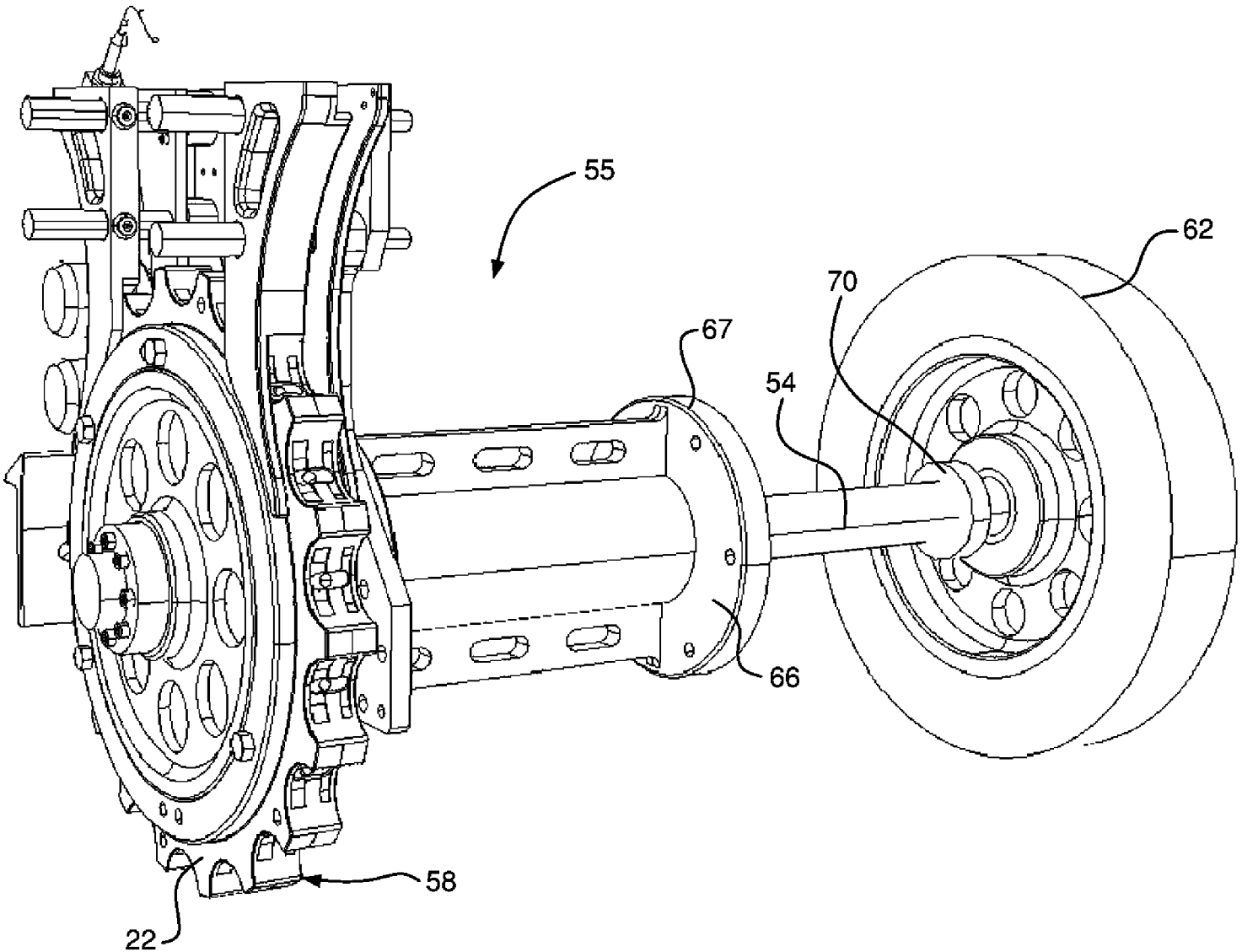
FIG. 3 is a perspective view of a transfer starwheel and gear mounted on a starwheel shaft of the multi-stage necking machine illustrated in FIG. 1, with surrounding and supporting parts removed for clarity.

Referring now to FIGS. 1 and 3, a horizontal structural support member 66 can support the transfer shaft 54. A mounting flange 67 can be disposed at the rear end of the support 66, and is configured to be bolted or otherwise attached to the upright support 21*b*. The support member 66 can further include a bearing (not shown in FIG. 3) disposed near the front end at a location inboard of the transfer starwheel 22. Accordingly, the transfer shaft 54 is supported by a rear bearing 70 (schematically illustrated in FIG. 3) that preferably is bolted to upright support 21*b*, and a front bearing that is supported by the support member 66, which itself is cantilevered from upright support 52, and further supported by the pedestal 21*a*. Preferably the base and upright support 52 is a unitary structure for each operation stage. The horizontal support member 66 and the front bearing are supported by the front end 27 of the support 21 (See FIG. 7).

Figure 4:
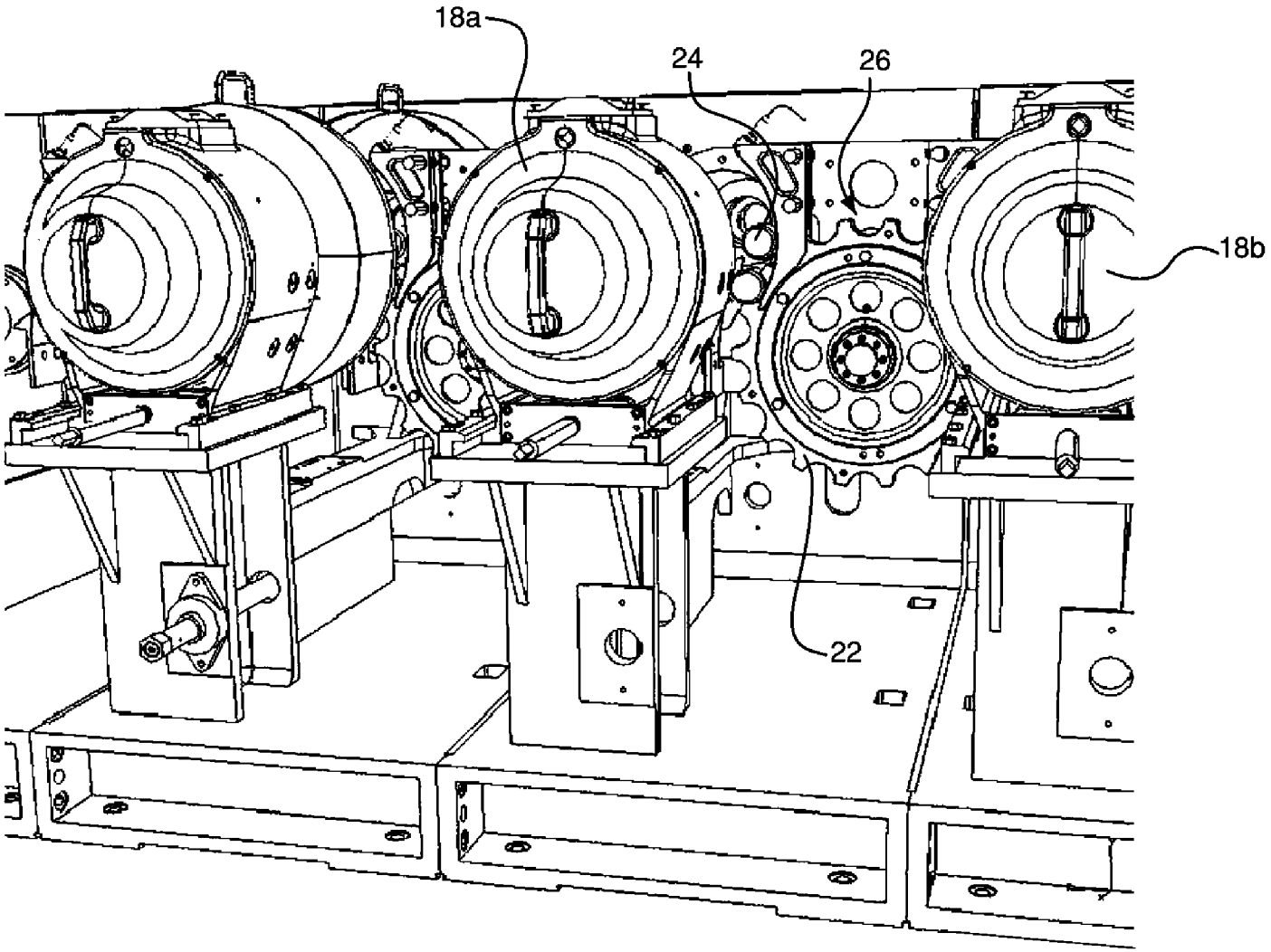
FIG. 4 is an enlarged perspective view of a portion of the multi-stage can necking machine illustrated in FIG. 1.

Referring now to FIG. 4, a can body 24 is shown exiting the necking stage 14 and is about to be transferred to a transfer starwheel 22. After the diameter of the end of the can body 24 has been reduced by the first necking station 18*a* shown in the middle of FIG. 4, main turret 26 of the necking station 18*a* deposits the can body into a pocket 58 of the transfer starwheel 22. The pocket 58 then retains the can body 24 using a vacuum force that is induced into pocket 58 from the vacuum system, which can be as described in co-pending U.S. patent application Ser. No. 12/108,950 filed on even date, and entitled "Adjustable Transfer Assembly For Container Manufacturing Process," the disclosure of which is hereby incorporated by reference as if set forth in its entirety herein. The pocket 58 carries the can body 24 through an arc over the bottommost portion of starwheel 22, and deposits the can body 24 into one of the pockets 42 of the main turret 26 of an adjacent necking station 18*b*. The necking station 18*b* further reduces the diameter of the end of the can body 24 in a manner substantially identical to that noted above.

The machine 10 can be configured with any number of necking stations 18, depending on the original and final neck diameters, material and thickness of can body 24, and like parameters, as understood by persons familiar with can necking technology. For example, multi-stage can necking machine 10 illustrated in the figures includes eight stages 14, and each stage incrementally reduces the diameter of the open end of the can body 24 as described above.

The can necking machine pockets can be monitored and controlled as described in co-pending U.S. patent application Ser. No. 12/109,131 filed on even date and entitled "Systems and Methods For Monitoring And Controlling A can Necking Process," the disclosure of which is hereby incorporated by reference as if set forth in its entirety herein. The main turrets and transfer starwheels of the can necking machine 10 can be configured in the manner described in co-pending U.S. patent application Ser. No. 12/109,176 filed on even date and entitled "High Speed Necking Configuration," the disclosure of which is hereby incorporated by reference as if set forth in its entirety herein.

As shown in FIG. 5, the multi-stage can necking machine 10 can include a plurality of motors 74 operable to drive the gears 46 and 62 of each necking stage 14 in the manner described in co-pending U.S. patent application Ser. No. 12/109,058 filed on even date, and entitled "Distributed Drives For a Multi-Stage Can Necking Machine," the disclosure of which is hereby incorporated by reference as if set forth in its entirety herein. As shown, one motor 74 can be provided per every four necking stages 14, or as otherwise desired. Each motor 74 is disposed proximate to the rear surface 25 of the support 21, and has a rear motor output shaft 77 that is coupled to and drives a first gear 80 by way of a gear box 82. The motor driven gears 80 then drive the remaining gears, such that the motors 74 and gears driven by the motors 74 provide a gear train 47. Each gear operably connected to the gear train 47 rotate along with the motors 74, which correspondingly rotates a rotatable component of the can necking machine 10. By using multiple motors 74, the torque required to drive the entire gear train 47 can be distributed throughout the gears, as opposed to conventional necking machines that use a single motor to drive the entire gear train 47.

Conventional can necking machines include a gear train that is driven by a single gear, and the gear teeth must therefore be sized according to the maximum stress. Because the gears closest to the conventional drive gearbox must transmit torque to the entire gear train (or where the single drive is located near the center on the stages, must transmit torque to about half the gear train), the maximum load on conventional gear teeth is higher than the maximum tooth load of the distributed gearboxes according to the present invention. The importance in this difference in tooth loads is amplified upon considering that the maximum loads often occur in emergency stop situations. The lower load or torque transmission of gears 46 and 62 allows the gears to be more readily and economically formed of a reinforced thermoplastic or composite, as described above, than similar transmission gears of conventional can necking machines.

Lubrication of the synthetic gears can be achieved with heavy grease or like synthetic viscous lubricant, as will be understood by persons familiar with lubrication of gears of necking or other machines, even when every other gear is steel as in the presently illustrated embodiment. Accordingly, the gears are not required to be enclosed in an oil-tight chamber, but rather merely require a minimal protection against accidental personnel contact Each motor 74 can be driven by a separate inverter which supplies the motors 74 with current. To achieve a desired motor speed, the frequency of the inverter output is altered, typically between zero to 50 (or 60 hertz). For example, if the motors 74 are to be driven at half speed (that is, half the rotational speed corresponding to half the maximum or rated throughput) they would be supplied with 25 Hz (or 30 Hz).

In one embodiment, the motors 74 can be configured as distributed drives, wherein each motor inverter is set at a different frequency. In one example, each downstream motor 74 can have a frequency that is approximately 0.02 Hz greater than the frequency of the immediately preceding upstream motor 73. It should be understood that the increment of 0.02 Hz can be variable, however, and can be by a small percentage of the frequency of motor operation (for instance less than 1%).

The downstream motors can thus be controlled to operate at a slightly higher speed to maintain contact between the driving gear teeth and the driven gear teeth throughout the gear train 47. Even a small freewheeling effect in which a driven gear loses contact with its driving gear could introduce a variation in rotational speed in the gear or misalignment as the gear during operation would not be in its designed position during its rotation. Because the operating turrets are attached to the gear train 47, variations in rotational speed could produce misalignment as a can body 24 is passed between starwheel pockets and variability in the necking process. The actual result of controlling the downstream gears to operate a slightly higher speed is that the motors all run at the same speed, with the downstream motors "slipping," which should not have any detrimental effect on the life of the motors. Essentially, the slipping motors are applying more torque, which causes the gear train 47 to be "pulled along" from the direction of downstream-most motor. Such an arrangement eliminates variation in backlash in the gears, as they are always contacting on the same side of the tooth, as shown in FIG. 6.

Figure 6:
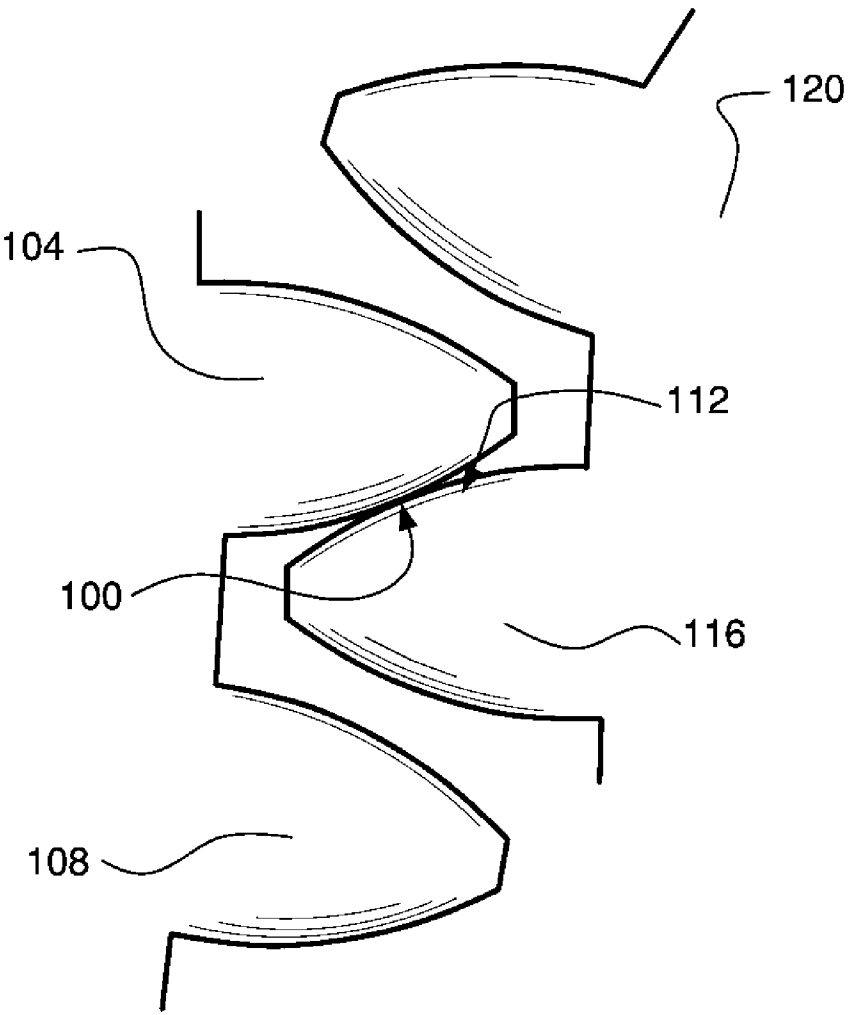
FIG. 6 is a partial expanded view depicting gear teeth from adjacent gears engaging each other.

As shown in FIG. 6, a contact surface 100 of a gear tooth 104 of a first gear 108 can contact a contact surface 112 of a gear tooth 116 of a second gear 120. This is also true when the machine starts to slow down, as the speed reduction is applied in the same way (with the downstream-most motor still being supplied with a higher frequency). Thus "chattering" between the gears when the machine speed changes can be avoided.

In the case of a machine using one motor, reductions in speed can cause the gears to drive on the opposite side of the teeth. It is possible that this can create small changes in the relationship between the timing of the pockets passing cans from one turret to the next, and if this happens, the can bodies can be dented.

Figure 7:
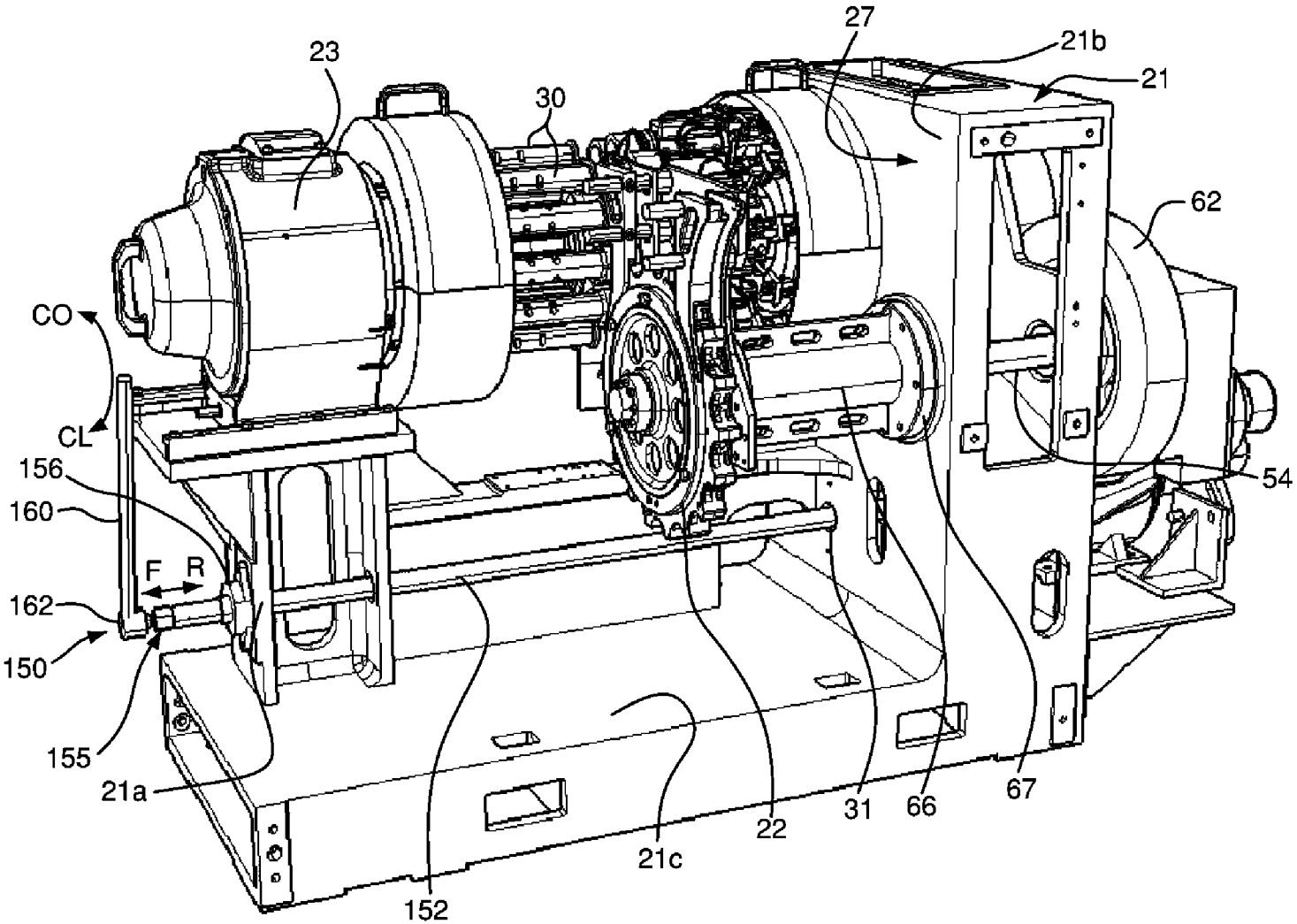
FIG. 7 is a perspective view of an operation stage of the multi-stage necking machine illustrated in FIG. 1, showing a motor coupled to the operation stage, and a winder assembly coupled to the motor.
Figure 8:
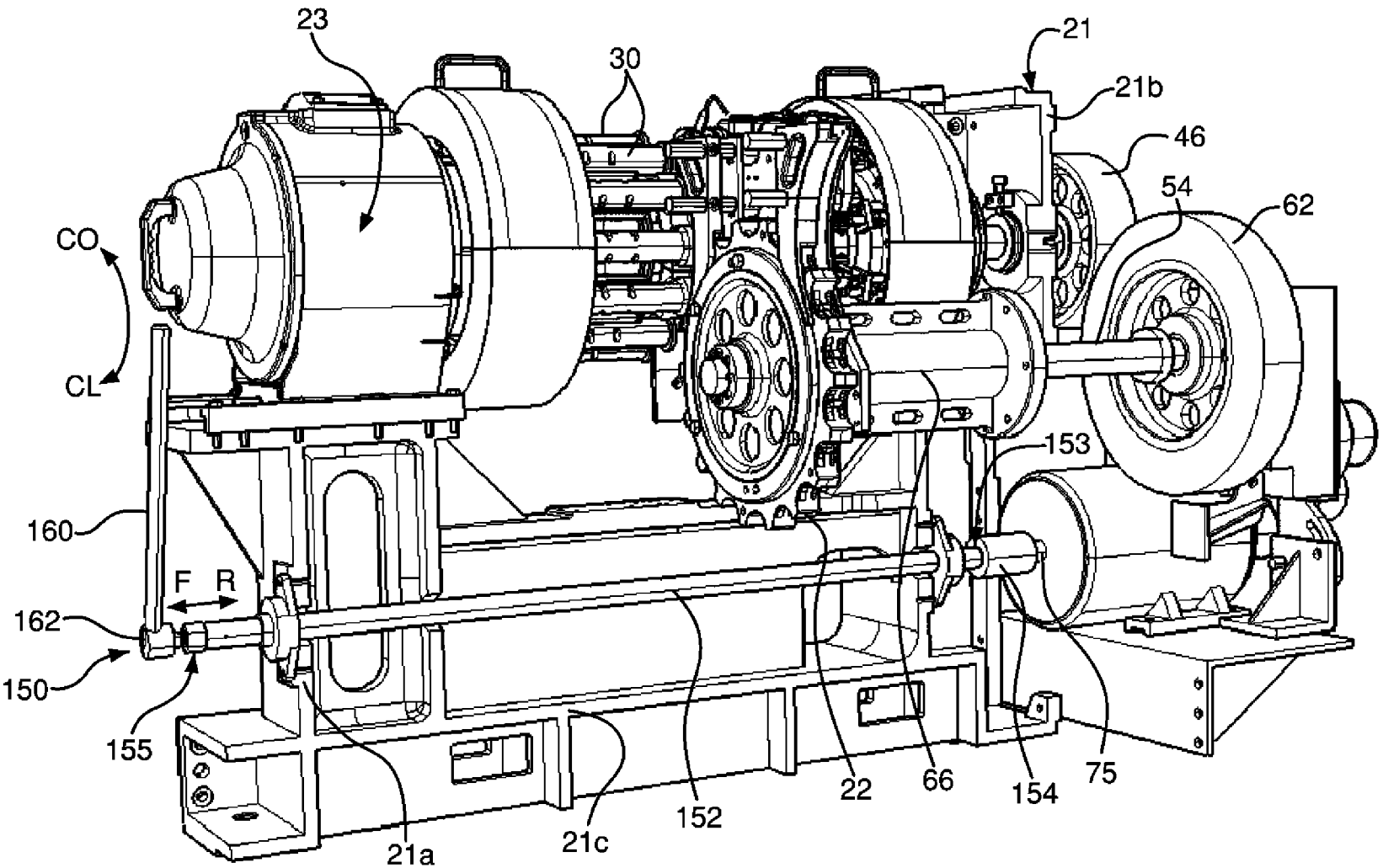
FIG. 8 is a perspective view of the operation stage illustrated in FIG. 7 having portions removed to further illustrate the winder assembly.

Referring now to FIGS. 7 and 8, the present invention recognizes that it may be desirable to perform maintenance on various rotating components of the can necking machine 10. When maintenance is to be performed, typically a specified location on the component needs to be accessible. Because the rotating components are in close proximity to each other, the can necking machine can include a winder assembly 150 operable to manually rotate the gear train 47 of the machine 10, which causes a desired rotating component to correspondingly move, or rotate, until the component has rotated to a desired angular position, whereby the specified location is out of interference with neighboring components, and is easily accessible to a user. For instance, it may be desirable to rotate the component such that the specified location is disposed at an upper end of the component. Example rotating components can include, but are not intended to be limited to, those components that carry can bodies during operation, such as the main turrets 26 of one of the can necking station 18 or other process stations, and the transfer starwheels 22.

The winder assembly 150 can extend from the front end 27 of the support 21, and in particular from the upright support 21*b*. Accordingly, a user can manually rotate the gear train 47 and simultaneously, or in close temporal proximity, observe the angular position of the component for which maintenance is to be performed. The winder assembly 150 can include a horizontally elongate winder shaft 152 that is coupled to the gear train 47, and in particular to the front end of one of the motors 74. Accordingly, rotation of the winder shaft 152 causes the associated motor 74 to rotate, which correspondingly drives the first gear 80 to rotate by way of the gear box 82 (see FIG. 5). Rotation of the first gear 80 causes the remaining rotatable components of the can necking machine 10 coupled to the gear train 47 to also rotate in the manner described above. It can thus be said that the winder shaft 152 is operably coupled to the gear train 47.

It should thus be appreciated that the motor 74 that is coupled to the winder assembly 150 can be provided with dual shaft outputs. The rear motor output shaft 77 can be coupled to the gear box 82, and a front motor output shaft 75 can be coupled to the winder shaft 152. A proximal end 153 of the winder shaft 152 can be connected to the motor output shaft 75 via any suitable coupling 154. The coupling 154 can be supported by the upright support 21*b*, and can include a bearing surface that allows the winder shaft 152 and motor shaft 75 to rotate within the coupling.

The winder shaft 152 extends forward from the motor 74, through an opening 31 formed in the upright support 21*b*, through the pedestal support 21*a*, and terminates at a distal end 155 that is disposed opposite the proximal end 153. A bearing 156 can be mounted onto the pedestal support 21*a*, such that the winder shaft 152 extends through the bearing 156 and can thus rotate with respect to the support 21.

With continuing reference to FIGS. 7-8, the winder assembly 150 further includes a winder handle 160 that can be attached to the winder shaft 152, for instance at the distal end 155. Actuating the handle 160 in a clockwise direction CL or a counterclockwise direction CO causes the shaft 152 to correspondingly rotate. It should thus be appreciated that the winder assembly 150 can rotate the gear train 47 and its associated components in either of two rotational directions. The handle 160 can have a length sufficient to generate adequate leverage, or mechanical advantage, so that a user can manually rotate the components of the can necking machine 10 with relatively little effort compared to conventional handwheels. Commonly available commercial ratchets can have a length of 740 mm, though the handle 160 is not to be construed as limited to that length.

As illustrated, the handle 160 can be provided in the form of a lever, though it should be appreciated that the handle 160 could alternatively be in the form of any structure that extends out from the shaft 152 and that is rotatably coupled to the shaft 152 such that rotation of the handle 160 causes the shaft 152 to correspondingly rotate. In one embodiment, the handle 160 can be a ratchet having a connection end 162 that is rotatably coupled to the shaft 152 in a first angular direction, but is rotatably decoupled from the shaft 152 in the opposing angular direction. The distal end 155 of the shaft 152 can include at least one substantially straight edge, and can be hexagonally shaped, to facilitate easy attachment to the connection end 162 of the ratchet 160 to the distal end 155.

The handle 160 can be connected to the shaft 152 without the use of additional tools, and can be removed from the shaft 152 without the use of additional tools. In one embodiment, the connection end 162 can be moved in a rearward direction R and manually fitted over the distal end 155 of the shaft 152, and can be removed from the shaft by manually sliding the connection end 162 in a forward direction F off the distal end 155.

Accordingly, when maintenance is to be performed on a desired rotating component of the can necking machine 10, the motors 74 are driven to a stop, which correspondingly stops the associated rotating components. The handle 160 is then connected to the shaft 152 in the manner described above, and the user can select whether to couple the handle 160 to the shaft 152 for rotation in the clockwise direction CL or in the counterclockwise direction CO. The user can then rotate the lever in the rotatably coupled direction to correspondingly rotate the components until the desired rotating component has reached a desired angular position that will allow the maintenance to be easily performed. The handle 160 can then be removed from the shaft 152, and the can necking operation can resume.

The can necking machine 10 can include an interlocked guard (not shown) that provides a physical barrier to the shaft 152 as the shaft rotates during operation of the can necking machine 10. The guard can be opened when it is desired to access the winder shaft 152. The guard can be configured to automatically stop the motors 74 in response to the guard being opened.

In one embodiment, the winder shaft 152 is coupled to one of the motors 74 to rotate the rotatable components coupled to the gear train 47. In another embodiment, more than one of the motors 74 can be coupled to the winder shaft 152 in the manner described above. In still other embodiments, each motor 74 can be coupled to the winder shaft 152 in the manner described above. Accordingly, the handle 160 can be connected to the winder shaft 152 that is in closest proximity to the desired component that is to be maintained, such that the user can easily visually observe the angular position of the desired component as the winder assembly 150 is actuated.

While the winder assembly 150 has been described in conjunction with certain illustrated embodiment, the present invention is intended to include within its scope alternative embodiments as defined by the appended claims. For instance, while the winder shaft 152 is illustrated as extending from the front motor output shaft, the present invention recognizes that the winder shaft 152 could alternatively extend from one or more gears or other rotatable components coupled to the gear train 47, such that rotating the shaft 152 in the manner described above would directly rotate the component connected to the shaft 152, which in turn would rotate the remaining rotating components coupled to the gear train 47. Additionally, the present invention further contemplates that an auxiliary motor could be coupled to the winder shaft 52 that could be actuated to rotate the components of the necking machine 10. Furthermore, it should be appreciated that a winder assembly of the type described herein can be applicable to rotatable components coupled to a gear train of different machines or manufacturing applications other than can necking applications. Further, the winder shaft 52 can be uncoupled from the motor and gearbox during normal operation, and only connected via a coupling or like attachment mechanism after machine 10 is shut down.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the present invention as defined by the appended claims

What is claimed is:

1. A multi-stage can necking machine comprising:

a plurality of operation stages, each operation stage including at least one rotating shaft projecting forward from a front end of a support; each operation stage including a rotatable turret located on the front end of the support; wherein each shaft includes a gear, and the gears of each operation stage are in meshed communication to form a continuous gear train, the gear train located on a rear end of the support opposite the front end of the support;

at least one motor operably coupled to the gear train and operable to transmit power to the gear train; and a winder assembly including a winder shaft operably coupled to the gear train and extending forward from the support, and the winder shaft is adapted to receive a handle, whereby the handle can be manually actuated to rotate the shafts of the plurality of operation stages via the gears to a desired angular position.

2. The multi-stage can necking machine as recited in claim 1, wherein the at least one shaft comprises a main turret shaft, and a transfer starwheel shaft.

3. The multi-stage can necking machine as recited in claim 1, wherein the winder shaft is coupled to the motor at a proximal end, and the handle is connected to the winder shaft at a distal end disposed opposite the proximal end.

4. The multi-stage can necking machine as recited in claim 3, wherein the distal end is hexagonally shaped.

5. The multi-stage can necking machine as recited in claim 1, wherein the handle is removably connected to the winder shaft.

6. The multi-stage can necking machine as recited in claim 1, wherein the handle is configured to rotate the winder shaft in only one direction of rotation.

7. The multi-stage can necking machine as recited in claim 6, wherein the direction of rotation is adjustable.

8. The multi-stage can necking machine as recited in claim 7, wherein the handle comprises a ratchet.

9. The multi-stage can necking machine as recited in claim 1, further comprising a plurality of motors distributed among the operation stages, and a second winder shaft connected to a second one of the plurality of motors.

10. The multi-stage can necking machine as recited in claim 1, wherein the support includes a pedestal disposed at a front end of the support, an upright support disposed at a rear end of the support, and a base connecting the pedestal and upright support, wherein the winder shaft extends through the upright support.

11. The multi-stage can necking machine as recited in claim 10, wherein each winder shaft extends forward from a different one of the plurality of motors and terminates at a distal end disposed forward of the pedestal.

12. The multi-stage can necking machine as recited in claim 1, wherein the winder shaft is oriented coaxially with a rotational axis of the motor.

13. A multi-stage can necking machine comprising:

a plurality of operation stages, each operation stage including a main turret shaft, a transfer starwheel shaft, wherein the turret shaft and the starwheel shaft extend forward from a front end of a support a first and second distance, respectively; wherein each shaft includes a gear, and the gears of each operation stage are in meshed communication to form a continuous gear train;

at least one motor operably coupled to the gear train and operable to transmit power to the gear train; and at least one winder assembly including a winder shaft operably coupled to the gear train and extending forward from the support a third distance greater than at least one of the first and second distances, whereby the winder shaft can be actuated to rotate the shafts of the plurality of operation stages via the gears to a desired angular position.

14. The multi-stage can necking machine as recited in claim 13, wherein the winder assembly further comprises a winder handle rotatably coupled to the winder shaft, whereby the handle can be manually actuated to rotate the shafts of the plurality of operation stages to a desired angular position.

15. The multi-stage can necking machine as recited in claim 13, wherein the winder shaft is coupled to directly to the motor.

16. The multi-stage can necking machine as recited in claim 15, further comprising a plurality of winder assemblies and a plurality of motors distributed among the operation stages, wherein each winder shaft of each winder assembly is coupled to a different one of the plurality of motors, such that any of the winder assemblies can be manually actuated to rotate the shafts of the plurality of operation stages.

17. The multi-stage can necking machine as recited in claim 16, wherein each of the plurality of motors is coupled to one of the winder shafts.

18. The multi-stage can necking machine as recited in claim 14, wherein the handle is connected to a distal end of the winder shaft, and the distal end is hexagonally shaped.

19. The multi-stage can necking machine as recited in claim 14, wherein the handle is configured to rotate the winder shaft in only one direction.

20. The multi-stage can necking machine as recited in claim 14, wherein the handle comprises a ratchet that is removably connected to the winder shaft.

21. A method of operating a multi-stage can necking machine of the type including a plurality of operation stages, each operation stage including at least one rotating shaft projecting forward from a front end of a support and a rotatable turret located on the front end of the support; wherein each shaft includes a gear, and the gears of each operation stage are in meshed communication to form a continuous gear train, the gear train located on a rear end of the support opposite the front end, at least one motor coupled to the gear train and operable to transmit power to the gear train; and a winder shaft operably coupled to the gear train and extending forward from the support, the method comprising the steps of:

attaching a handle to the winder shaft so that the handle is rotatably coupled to the winder shaft; and manually rotating the handle such that the at least one rotating shaft of each operation stage rotates with the handle.

22. The multi-stage can necking machine as recited in claim 13, wherein the third distance is greater than both the first and second distances.

* * * * *